US005283540A

United States Patent [19]

Myer

[11] Patent Number: 5,283,540

[45] Date of Patent: Feb. 1, 1994

[54] COMPACT SIGNAL ISOLATING MICROWAVE SPLITTERS/COMBINERS

[75] Inventor: Robert E. Myer, Denville, N.J.

[73] Assignee: AT&T Bell Laboratories, Murray Hill, N.J.

[21] Appl. No.: 919,444

[22] Filed: Jul. 27, 1992

[51] Int. Cl.[5] ..... H01P 5/12

[52] U.S. Cl. ..... 333/127; 333/136

[58] Field of Search ..... 333/123, 124, 125, 127, 333/128, 136

[56] References Cited

U.S. PATENT DOCUMENTS

| | | | |
|---|---|---|---|
| 4,032,849 | 6/1977 | Gysel et al. . | |
| 4,163,955 | 8/1979 | Iden et al. | 333/127 |
| 4,175,257 | 11/1975 | Smith et al. | 330/287 |
| 4,234,854 | 11/1980 | Schellenberg et al. | 330/286 |
| 4,263,568 | 4/1981 | Nemit | 333/127 |
| 4,323,863 | 4/1982 | Weber | 333/109 |
| 4,375,622 | 3/1983 | Hollingsworth et al. | 333/127 X |
| 4,394,629 | 7/1983 | Kumar et al. | 333/109 |
| 4,700,145 | 10/1987 | Yelland et al. | 330/286 |
| 4,812,782 | 3/1989 | Ajioka | 330/286 |
| 4,825,175 | 4/1989 | Tsuda et al. | 330/286 |

OTHER PUBLICATIONS

"A New N-Way Power Divider/Combiner Suitable for High-Power Applications" by U. H. Gysel, *MIT Symposium* Digest, 1975 pp. 116–118.

"An N-Way Hygbrid Power Divider" by E. J. Wilkinson, *IRE Transaction on Microwave Theory and Techniques*, 1960, pp. 116–118.

"A Note on N-Way Hybrid Power Dividers" by J. J. Taub & B. *Fritzgerald, IEEE Transactions of Microwave theory and Techniques* pp. 260–261, Mar. 1964.

"N-Terminal Power Divider" by R. W. Peterson, *IRE Transaction on Microwave Theory and Techniques*, p. 571, Nov. 1961.

*Primary Examiner*—Paul Gensler

*Attorney, Agent, or Firm*—Ruloff F. Kip, Jr.

[57] ABSTRACT

A microwave splitter/combiner has a flat housing comprising similar top and bottom horizontal circular cover plates joined at their peripheries by an annular flange of short vertical length. The top plate and flange mount on their respective outsides a primary signal transfer coaxial connector and a plurality of secondary signal transfer connectors of which the latter are spaced around the flange. A plurality of first coaxial line sections inside the housing lie in a common horizontal plane and are all coupled to the primary connector and each coupled to a respective one of such secondary connectors, the housing being suitably apertured to permit such couplings. A plurality of second coaxial line sections inside the housing are respectively coupled to such first sections and are all coupled to each other in such fashion as to suppress the appearance at the secondary connectors of extraneous signals. Such second sections are L-shaped and lie in respective planes departing from the horizontal by at most a small acute angle.

5 Claims, 7 Drawing Sheets

FIG. 9
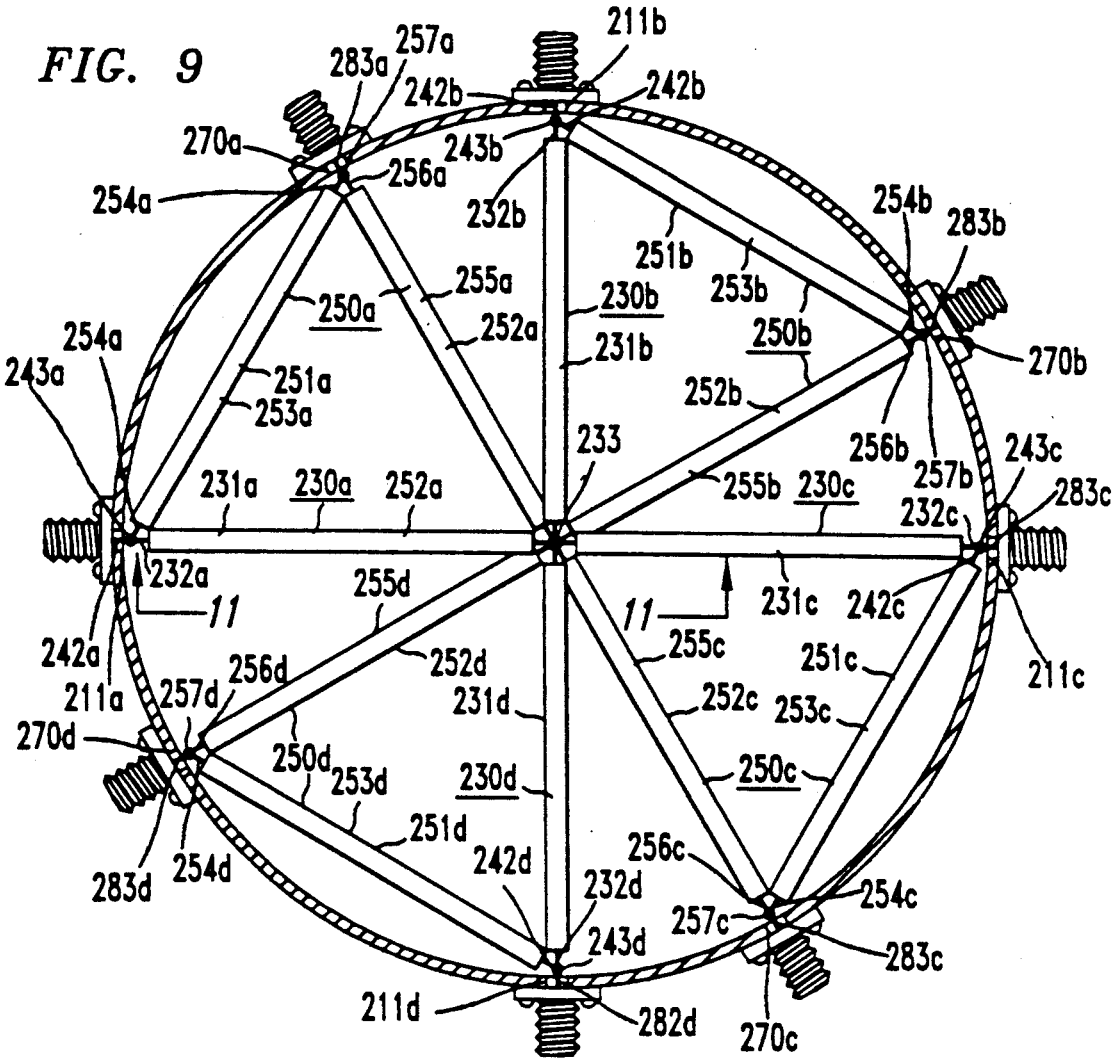
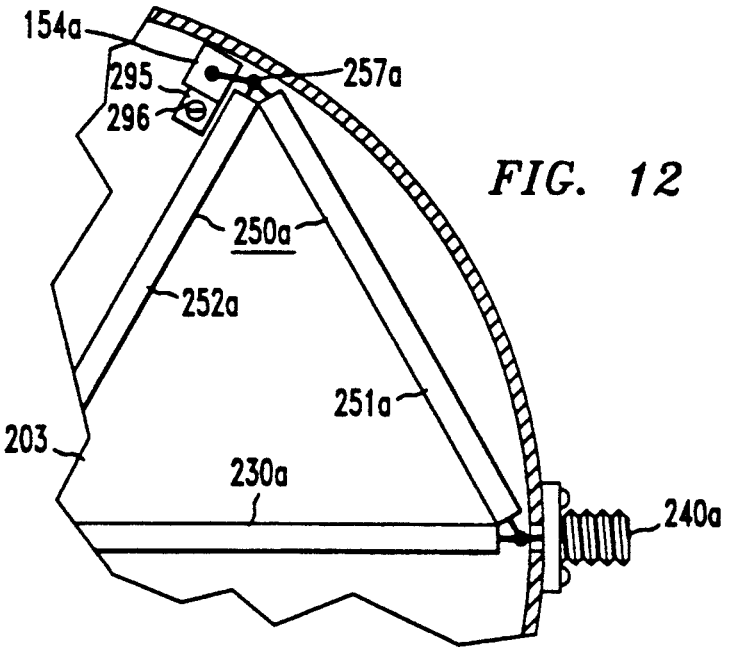
FIG. 12

COMPACT SIGNAL ISOLATING MICROWAVE SPLITTERS/COMBINERS

TECHNICAL FIELD

This invention relates generally to assemblages for handling microwave signals, and which may be splitters or combiners of such signals. More particularly, this invention relates to assemblages of such kind which comprise a primary signal transfer port, a plurality of secondary signal transfer ports, and a plurality of principal signal transfer paths each extending between a corresponding one of said secondary ports and said primary port. When the assemblage is a combiner, individual signals are received at the secondary ports and flow therefrom through such paths to the primary port to there combine to form an output signal from such port. When the device is a splitter, an input signal to the primary port is distributed through such paths to such secondary ports to be split among them so as the convert the input signal into separate output signals. Usually the signal which is an input to or an output from the primary port is a composite signal which consists of a combination of individual microwave signals in different bandwidth channels and which composite signal has a midfrequency and a nominal bandwidth centered on such midfrequency.

BACKGROUND OF THE INVENTION

Assume that the assemblage described above is a combiner having six input ports receiving corresponding signals which are transferred from such ports to the common port to provide therefrom an output combining such originally separate signals. In the case of, say, the signal which is received by the #1 input port and conducted in a path #1 from such port towards the output port, a fraction of that signal will, on its reaching the end of the #1 path, be diverted through the output port to become a desired component of the composite output signal. Since, however, at such end of that #1 path, the other five input ports are electrically coupled in parallel with the output port, other fractions of the #1 signal will, unless something is done, reach such other input ports to there be manifested as extraneous signals. The presence of such extraneous signals at such ports is undesirable because they may flow reversely through such ports, and because of other detrimental electrical effects likely to be produced.

It has been proposed in an article "A New N-Way Power Divider/Combiner Suitable for High Power Applications" authored by Ulrich H. Gysel and published in the MIT Symposium Digest, 1975, pages 116–118 that such problem may be overcome as follows. As disclosed in that article, a microwave circuit (which will be assumed to be a combiner circuit) comprises circuit boards and, also, transmission lines which are all in the form of striplines printed on such boards except that one of such lines is a coaxial line. In such circuit, a primary port is connected by a coaxial line $Z_1$ to a junction to which are also connected a plurality of striplines $Z_2$ connected at their ends away from such junction to corresponding secondary ports. The lines $Z_2$ provide principal paths for transfer of microwave signals between the secondary ports and the mentioned junction.

In order for a signal received at any one secondary port to reach through principal paths any other secondary port as an extraneous signal, that signal must travel through two principal paths a distance between those two ports which is a half wavelength of the microwave signal at the midfrequency of the combiner. The results is that such extraneous signal undergoes approximately a 180° phase shift in the course of such travel.

To reduce the presence of the extraneous signals at the secondary ports, these ports are respectively connected to a plurality of supplemental signal transfer paths each consisting of a stripline $Z_3$ and a stripline $Z_4$ in series, and all connected to a common floating point at their ends away from the secondary ports. Each of such supplemental paths has a length of one half wavelength. Because of the existence of these supplemental paths, the signal received at any one secondary port can reach any other secondary port as an extraneous signal not only through two principal paths as described above but also through two supplemental paths. However, the fraction of that signal which travels through the two supplemental paths to the destination port undergoes in the course of such travel a phase shaft of 360° so as to be exactly out of phase with the fraction of extraneous signal reaching that port through the two principal paths. Hence, if the extraneous signal fractions reaching that destination port through, respectively, the two principal paths and the two supplemental paths are of about the same amplitude (as can be realized), these two signal fractions will almost wholly cancel each other out so as to reduce to low level the resultant extraneous signal at that port.

The circuit disclosed by the Gysel article has, however, the disadvantages that, because of the several odd impedance transmission lines required, stripline or microstrip construction is indicated. However, for high power combining of larger numbers of signals with minimum loss, stripline does not work well, and the circuit is undesirably limited as to the microwave power it can handle as a result of the lower power carrying capacity of the striplines.

One or more of the disadvantages just mentioned of the Geysel circuit are overcome according to the invention which is disclosed and claimed in my U.S. Pat. No. 5,223,809 for "Signal Isolating Microwave Splitters/-Combiners" issued Jun. 29, 1993 and assigned to the assignee hereof. The exemplary embodiment of the invention disclosed in that earlier filed application is a microwave assemblage of a configuration enabling it to incorporate therein a number of secondary ports which can vary in number to six or to even more than six, that particular embodiment having six of such ports. Often, however, when only two, three or four of such ports are required, the spatial features of that assemblage which are used in it to accommodate a larger number of secondary ports are not needed, and the presence of those features in the configuration causes it to occupy space which might well be put to better purposes. Moreover, such assemblage is of costly construction because its structure incorporates a large number of expensive junction boxes.

SUMMARY OF THE INVENTION

The space per secondary port which is occupied in splitter/combiners of the kind described is compacted according to the present invention by providing a microwave assemblage comprising a primary coaxial signal-transfer connector having a vertical axis, a plurality of first coaxial line sections extending horizontally and in angularly spaced relation from inner ends thereof adjacent to and electrically coupled to said connector to outer ends of such sections, a plurality of secondary coaxial signal-transfer connectors respectively corresponding to said first sections and disposed at their outer ends in electrically coupled relation therewith, a plurality of second coaxial line sections respectively corresponding to said first sections and each of "L" shape so as to have two arms and a bend therebetween, and having respective outer and inner ends spaced away from the bends in such sections, and of which such outer ends of said second sections are mechanically and electrically coupled with said first sections at their outer ends, and the inner ends of said second sections are adjacent to each other and electrically and mechanically coupled coupled together at a common junction, said second coaxial line sections lying in respective planes which are disposed to be displaced away from the vertical in the same angular direction around said axis so as to each project angularly away from the corresponding first coaxial line section towards the first coaxial line section next adjacent in such angular direction.

BRIEF DESCRIPTION OF THE DRAWING

For a better understanding of the invention, reference is made to the following description of a representative embodiment thereof, and to the accompanying drawings wherein:

FIG. 9 is an enlarged plan view in cross-section, taken as indicated by the arrows 9—9 in FIG. 7 combiner;

FIG. 12 is a broken away-bottom view, taken as indicated by the arrows 12—12 in FIG. 8, of another modification of such one detail.

Figure 1:
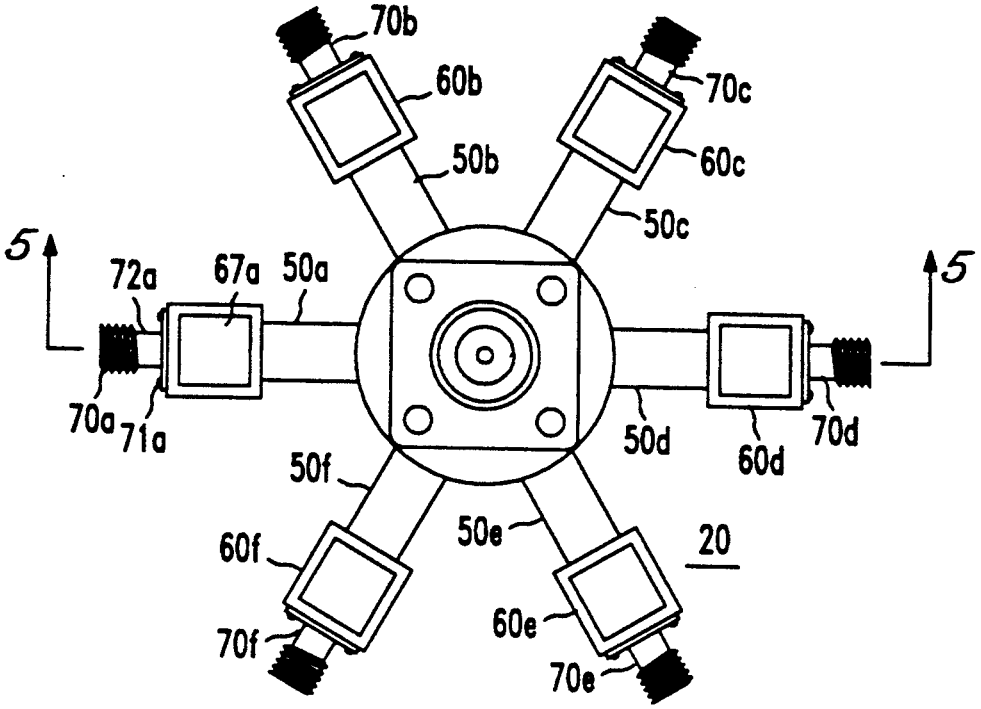
FIG. 1 is a plan view of an exemplary embodiment of the invention in the form of a six-way combiner.

In the description which follows, elements which are counterparts of each other are designated by the same reference numeral while being distinguished by different alphabetical suffixes appended to that numeral, and it is to be understood that a description of any one such element shall, unless the context otherwise indicates, be taken as being equally applicable to all its counterparts.

DETAILED DESCRIPTION OF EMBODIMENT

Referring now to FIGS. 1–6, the reference numeral 20 designates a microwave assemblage of which the structure is functionally suitable for use as either a six-way splitter or six-way combiner, but which will initially herein be considered to be a combiner.

The combiner 20 has a vertical axis 21, and upper and lower axially spaced hubs 22 and 23 coaxial with axis 21.

Figure 2:
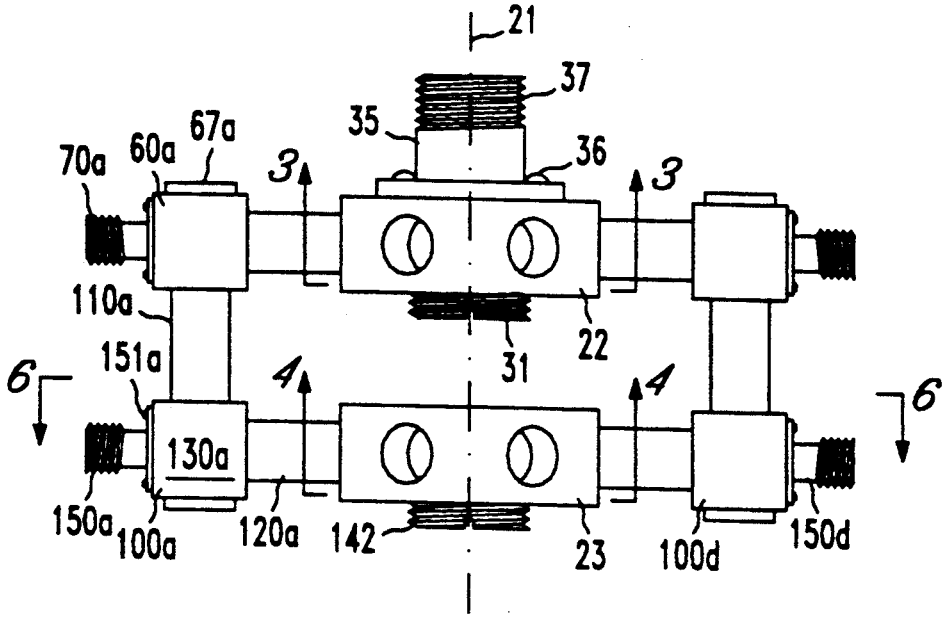
FIG. 2 is a front elevation of the FIG. 1 combiner with the front and rear extensions from the central hubs of the combiner being removed so as to show only those side extensions from such hubs which lie in a plane parallel to that of the drawing.
Figure 3:
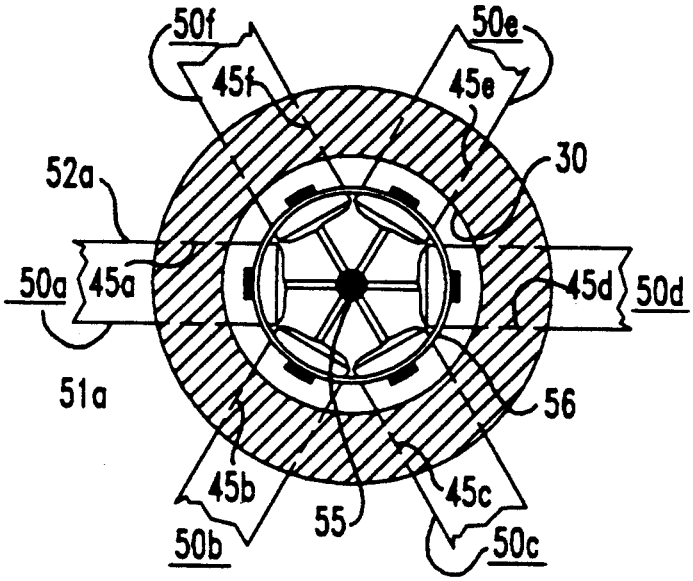
FIG. 3 is a fragmentary bottom view in cross-section, taken as indicated by the arrows 3—3 in FIG. 2, of the upper hub of the FIG. 1 combiner.
Figure 4:
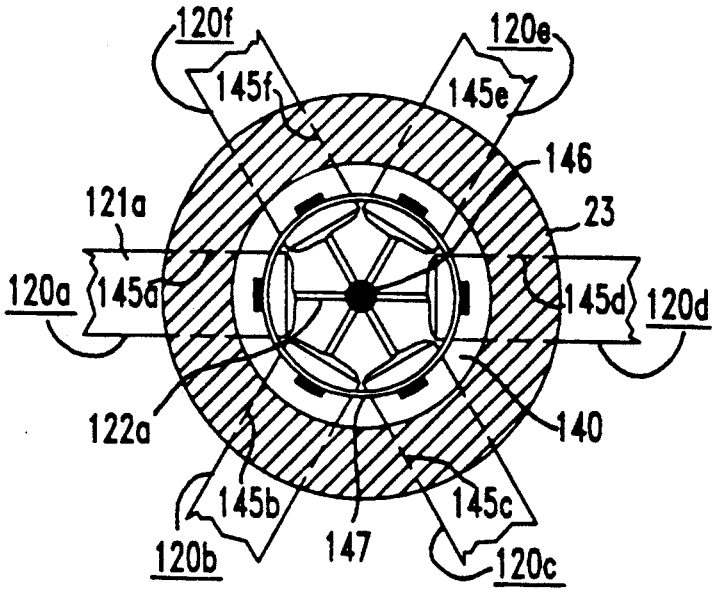
FIG. 4 is a fragmentary bottom view in cross-section, taken as indicated by the arrows 4—4 in FIG. 2, of the lower hub of the FIG. 1 combiner.

Upper hub 22 is in the form of a moderately thick circular cylindrical disc having its centerplane normal to axis 21, and having therein a large circular cylindrical bore 30 (FIG. 5) extending axially all the way through the hub. Bore 30 at its lower end has an internally threaded wall with which is engaged peripheral threading on a closure disc 31 adapted by turning it to be removed from the bore to provide access to its interior. In FIG. 2, disc 31 is shown as only partly screwed into bore 30.

At the upper end of bore 30 is a rigid primary coaxial signal transfer connector 35 of standard N type construction and mounted by screws 36 on the top of hub 22 to close off and be coaxial with bore 30. Connector 35 has a tubular outer conductor 37 externally threaded at its top, and the connector also has an inner filamental conductor 38 extending axially forward of conductor 37 to form a pin 39 projecting down into bore 30.

When assemblage 20 is in use, the primary connector 35 is adapted to be electromechanically coupled to means which is external to the assemblage and which, for example, may be a coaxial cable 40 (FIG. 5) having at its end rear device 20 a fitting comprising a rotatable internally threaded cap 41 adapted to be threaded onto connector 35 to thereby couple the cable and connector together. Cable 40 may lead to, say, an antenna or other device (not shown) which, when assemblage 20 is a combiner, receives and utilizes the composite microwave signal which is the output of the combiner 20.

Equiangularly spaced around hub 22 are six small bores 45*a*–45*f* (FIG. 3) formed in the hub to be normal to axis 21 and extend radially from large bore 30 entirely through hub 22 to its outer periphery. Received with a tight fit in bores 45*a*–45*f* are inner portions of six respectively corresponding "first" coaxial line sections 50*a*–50*f* soldered to hub 22 at the point of entry of these sections into the hub.

These coaxial line sections have outer portions which are disposed outside hub 22, are of greater length than the inner hub portions, and project outward like spokes from the hub to form a star pattern. The first coaxial line sections 50 are all, mechanically speaking, rigid elements which are mechanically coupled together by hub 22 to all be in positionally fixed relation with each other and with the primary connector 35.

Considering the first coaxial line section 50*a*, it consists of a single continuous length of a coaxial line comprising (FIG. 5) a filamental inner conductor 51*a*, a tubular outer conductor 52*a* and dielectric material 53*a* disposed between conductors 51*a*, 52*a* and maintaining them in concentric relation. The outer conductor 52*a* is an electroconductive pipe which renders rigid the coaxial line 50*a*, and which serves both as the grounded outer electrical conductor for that line and as its external protective sheath which, when outside hub 22, is exposed to the exterior environment of assemblage 20.

At the inner end of line 50a, its inner conductor 51a projects forward of its outer conductor 52a and into the center of bore 30 to make an electromechanical junction 55 at the end of that inner conductor with the bottom of the inner conductor pin 39 of the primary connector 35. The inner conductors of all of the other coaxial lines 50b–50f are similarly united at that junction 55 with such pin 39.

The junction 55 is surrounded by a copper grounding ring 56 electromechanically connected by solder to the outer conductors of all the coaxial lines 50a–50f at the inner ends of these conductors projecting into the bore 30.

Disposed at the outward ends of the coaxial lines 50a–50f are six respectively corresponding hollow cubic junction boxes 60a–60f (FIGS. 1 and 2) of which the box 60a is exemplary. The box 60a comprises a cubic copper housing 61a, a cubic cavity 62a within that housing, registering circular passages 63a, 64a extending radially through housing 61a on radially opposite sides of cavity 62a, and registering circular passages 65a, 66a extending axially through housing 61a on axially opposite sides of that cavity.

A radially outer portion of coaxial line 50a is received with a tight fit in the radially inner passage 63a in housing 61a, and the line and housing are soldered together. With the outer end of the line 50a being so received in that passage, the inner conductor 51a projects forwardly to the center region of cavity 62a. In consequence of the tight fit and soldering just mentioned, the box 60a is united to and supported by the rigid line 50a to be held thereby in fixed position relative to all of lines 50a–50f and the primary connector 35. All of the other boxes 60b–60f are similarly positionally fixed by their corresponding rigid lines 50b–50f to all other of such lines and connector 35.

The six boxes 60a–60f carry six respectively corresponding secondary signal transfer coaxial connectors 70a–70f which are smaller in size than the primary connector 35, but which are of the same type as is that connector. The connector 70a is exemplary of all of them. Connector 70a is mounted by screws 71a on the radially outer side of the housing 61a of the box 60a to cover the outer end of, and be concentric with, the radial passage 64a (FIG. 5) through that housing. Connector 70a has an outer conductor 72a which is externally threaded at its radially outer end, and the connector also has an inner filamental conductor 73a projecting into the central region of cavity 62a of box 60a to there be united at an electromechanical solder junction 74a with the inner conductor 51a of the coaxial line 50a. Apart from providing space for such junction, the box 60a serves as a mechanical coupling of the connector 70a to the line 50a in fixed positional relation therewith so that such connector 70a is positionally fixed relative to all of elements 22, 35, 50a–50f and 60a–60f.

The upper axial passage 65a through the housing 61a of box 60a is shown as being closed at its outer end by a thin sheet metal lid 67a. Prior to and during the making of junction 74a by soldering, lid 67a is not present on box 60a, and the passage 65a is open to provide access to the center of box cavity 62a to permit the making of that junction. After such junction has been formed, the lid 67a is soldered onto the top of box housing 61a.

When assemblage 20 is used as a combiner, the secondary connectors 70a–70f receive respective inputs from six microwave signal sources which may be, say microwave amplifiers of which the amplifiers 80a and 80d (FIG. 5) are exemplary. The output of amplifier 80a is connected to one end of a coaxial cable 81a terminating at its other end in a fitting comprising an internally threaded rotatable cap 82a. In the use of the combiner, the cap 82a is turned to engage its threading with the external threading on connector 70a so as to couple amplifier 80a through cable 81a to connector 70a. The other microwave amplifiers which respectively correspond to connectors 70b–70f are, in the use of combiner 20, similarly coupled to their corresponding connectors.

With connectors 70a–70f being coupled as described to receive inputs of microwave signals from external sources thereof, the coaxial lines 50a–50f serve as principal paths for transfer of such signals from such secondary connectors to the primary connector 35. As earlier discussed, however, a fraction of the microwave signal which is an input to any one of the secondary connectors will appear as an extraneous signal of significant level at all other of such secondary connectors in the absence of means to prevent that occurrence. Microwave assemblage 20 has such means which is as follows.

Assemblage 20 includes not only six "first" coaxial line sections 50a–50f but also six "second" coaxial line sections 100a–100f which respectively correspond to those first sections, and of which the second section 100a is exemplary. Section 100a is a composite structure having the shape of an "L" and comprising a radially outer vertical coaxial line 110a corresponding to the vertical arm of the "L", a radially extending horizontal coaxial line 120a corresponding to the horizontal arm of the "L" and a junction box 130a in the form of a hollow cube and disposed at the bend of the "L" where its arms intersect. The junction box 130a comprises a copper housing 131a, a cubic cavity 132a inclosed by that housing, registering radial passages 133a and 134a passing through inner and outer sides of housing 131a on radially opposite sides of cavity 132a, and registering axial passages 135a, 136a passing through upper and lower sides of housing 131a on axially opposite sides of the mentioned cavity. Upper axial passage 135a has received therein with a tight fit the lower end of vertical coaxial line 110a of which the upper end is received with a tight fit within the lower axial passage 66a formed in junction box 60a. Line 110a is also soldered to both of junction boxes 60a and 130a. Moreover, line 110a is a rigid coaxial line similar in construction to the line 50a earlier described. By virtue of line 110a being a rigid line and its tight fit within boxes 60a and 130a and its solder connection to both such boxes, the line 110a maintains box 130a in fixed positional relation to box 60a and, also, because of the fixed positional relations already described, to elements 50a–50f, 60a–60f, 70a–70f, hub 22 and primary connector 35.

Figure 5:
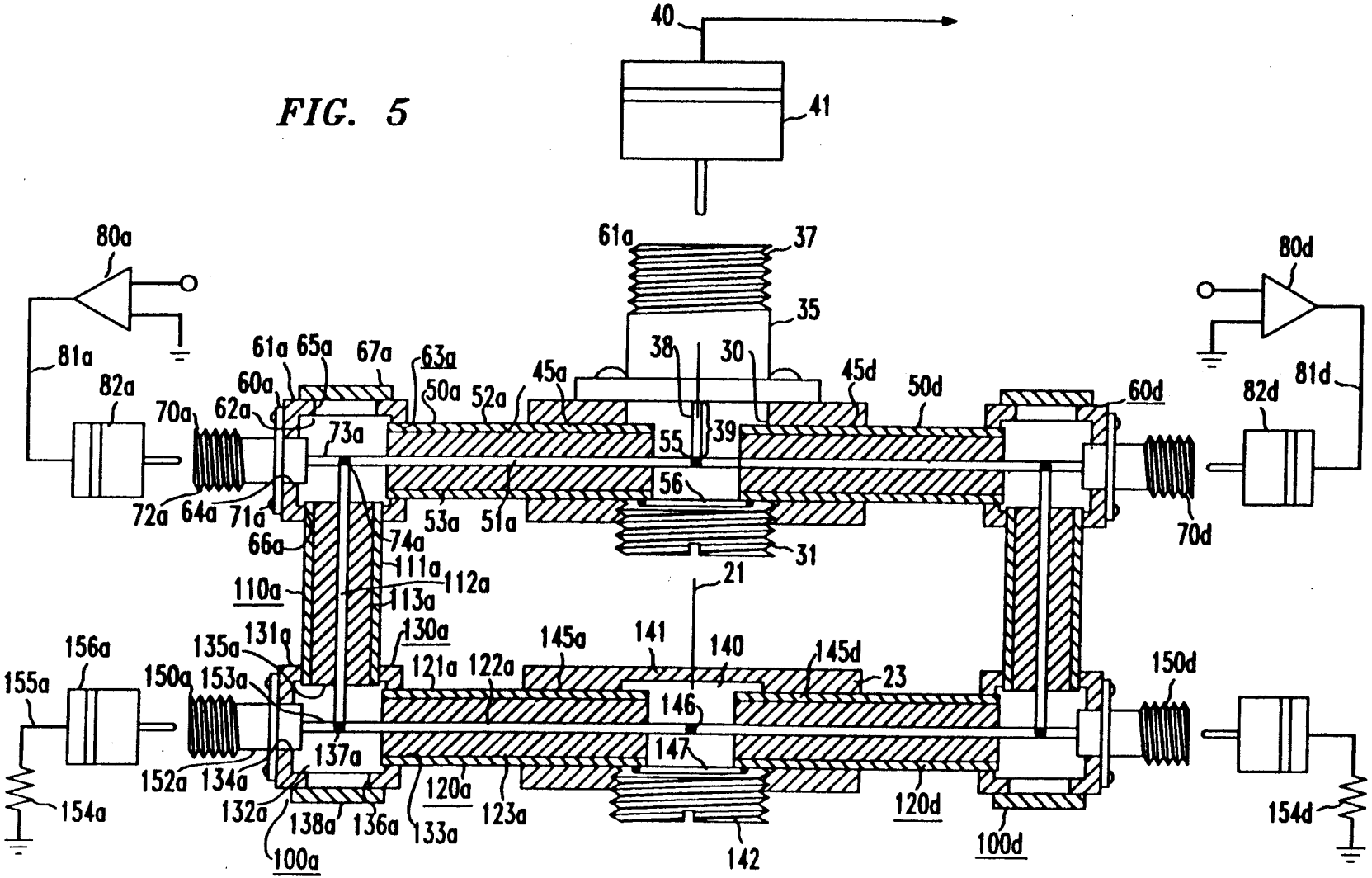
FIG. 5 is a front elevation in cross-section, taken as indicated by the arrows 5—5 in FIG. 1, of the FIG. 1 combiner.
Figure 6:
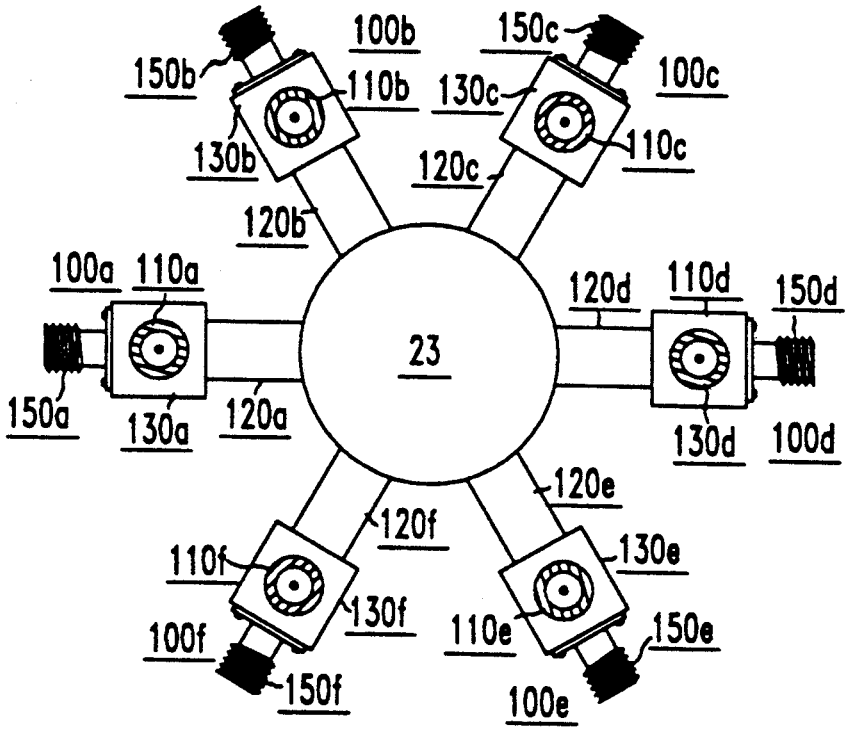
FIG. 6 is a plan view in cross-section, taken as indicated by the arrows 6—6 in FIG. 2 of the lower half of the FIG. 1 combiner.

As best shown in FIG. 5, the vertical coaxial line 110a comprises an outer conductor 111a in the form of a rigid electroconductive pipe, a filamental inner conductor 112a and dielectric material 113a disposed between conductors 111a and 112a and maintaining them in positionally fixed concentric relation. The upper end of inner conductor 112a projects into cavity 62a of box 60a to be united with the electromechanical junction 74a in that cavity of the inner conductors of, respectively, the secondary connector 70a and the "first"

coaxial line 50*a*. The lower end of conductor 112*a* projects into the central region of the cavity 132*a* of the junction box 130*a*.

The junction boxes 130 are at the level of the lower hub 23 of the assemblage 20. Hub 23 is disposed with its center plane normal to the assemblage axis 21, and the hub is similar in external shape to hub 22. Hub 23 has formed therein a large central cylindrical bore 140 (FIG. 5) having an opening at the bottom of the hub and extending upwards from that opening. Bore 140 does not, however, pass all the way vertically through the hub but, rather, is closed at its top by a web 141 so as to be a blind passage through the bore. The wall of bore 140 at its bottom has internal threading engaging with peripheral threading on a closure disc 142 adapted by its turning to selectively either be removed from the bore or to be inserted therein so as to form a closure for its bottom. In FIGS. 2 and 5 the disc 142 is shown as partly removed from bore 140.

Equiangularly disposed around hub 23 are six small horizontal bores 145*a*–145*f* radially extending outward from bore 140 through hub 23 to its periphery. These six bores respectively correspond to the six coaxial lines 120*a*–120*f* providing the respective horizontal arms of the "L" shaped "second" coaxial line sections 100*a*–100*f*. Of the six coaxial horizontal lines, the already mentioned line 120*a* is exemplary.

The line 120*a* has its radially inner end and radially outer end received with a tight fit in, respectively, the radial passage 133*a* through the radially inner side of junction box housing 131*a*, and the radial passage 145*a* in the hub 23. Further, the line 120*a* is a rigid line soldered both to junction box 130*a* and hub 23. Because of the tight fit of line 120*a* in the two passages just mentioned and the rigidity of such line and its soldering to elements 23 and 130*a*, and, because, moreover, of the fixed positional relations already described as having been established, the coaxial line 120*a* helps support hub 23, and is itself supported, to be in positionally fixed relation to all the other elements included in assemblage 20.

As an electrical element, the coaxial line 120*a* is similar to the coaxial line 110*a* already described. That is, the line 120*a* comprises an outer conductor 121*a* in the form of a rigid electroconductive pipe, an inner filamental conductor 122*a* and dielectric material 123*a* disposed between conductors 121*a* and 122*a* to maintain them concentric. The radially outer end of conductor 122*a* extends into the central region of the cavity 132*a* of junction box 130*a* so that the tip of conductor 122*a* is united to the tip of inner conductor 112*a* at an electromechanical junction 137*a* of those two inner conductors. During forming of junction 137*a* by soldering, the lower axial passage 136*a* of box 130*a* is kept open to provide access to the interior of such junction but thereafter that passage is closed by a lid 138*a* soldered to box 130*a*.

The radially inner end of inner conductor 122*a* projects into the central region of the bore 140 in hub 23 to an electromechanical junction disposed in that region and designated as junction 146 and constituting an electromechanical junction of the radially inner ends of all of the inner conductors 120 of the second coaxial line sections 100*a*–100*f*.

Having described the parts of coaxial line section 100*a* and the way in which it is mechanically and electrically incorporated into assemblage 20, it will be appreciated that all of the other second coaxial line sections 100*b*–100*f* are similarly incorporated therein. That is, each of such other "L" shaped sections 100*b*–100*f* is, at its upper end (a) fixedly coupled mechanically to the corresponding one of junction boxes 60*b*–60*f*, and (b) electrically coupled by the inner conductor of its axially aligned coaxial line to the junction of the respective inner conductor of the corresponding one of first coaxial line sections 50*b*–50*f* and the corresponding one of secondary connectors 70*b*–70*f*, and, each of sections 100*b*–100*f* is, at its radially inner end, (c) fixedly mechanically coupled to hub 23, and (d) electrically coupled by the inner conductor of its radial coaxial line to junction 146 which, as stated, is the common junction of the radially inner ends of the inner conductors of all of the coaxial line sections 100*a*–100*f*.

The junction 146 serves, electrically speaking, as a common floating point for such inner conductors. The junction is surrounded in bore 140 by a copper grounding ring 147 (FIG. 4) electromechanically connected by solder to the outer conductors of radial coaxial lines 120*a*–120*f* at the inner ends of those conductors projecting radially into the bore. Each of those lines 120 lies in the same axial-radial plane as does the corresponding one of the coaxial lines 50, and, as in the case of those upper radial lines 50 the lower radially extending lines 120 have outer portions projecting out in a star pattern from the periphery of hub 23.

The junction boxes 130*a*–130*f* at the bends of the L-shaped second coaxial line sections 100*a*–100*f* serve as supports for a set of respectively corresponding external load coaxial connectors 150*a*–15*f* (FIG. 6) of which the connectors 150*a* and 150*d* (FIGS. 2 and 5) are exemplary. The connector 150*a* is mounted by screws 151*a* on the radially outer side of junction box 130*a*, is a standard type coaxial connector, and comprises an outer conductor 152*a* which is externally threaded at its radially outer end, and, also, an inner conductor 153*a* extending onto the cavity 132*a* of junction box 130*a* to be united at junction 137*a* with the inner conductors of the coaxial lines 110*a* and 120*a*. FIG. 5 shows in association with connector 150*a* a grounded external load resistor 154*a* attached at its non-grounded end to a coaxial cable 155*a* terminating at its end away from the resistor in a fitting comprising an internally threaded rotatable cap 156*a*. In the use of the combiner 20, the cap 156*a* is threaded onto the outer conductor 152*a* of connector 150*a* to electrically couple resistor 154*a* through cable 155*a* to coaxial section 100*a* at the junction of the two coaxial lines 110*a* and 120*a* included in that section.

From the mechanical viewpoint, the whole assemblage 20 is a rigid mechanical structure which is rugged and durable, and which completely confines within its interior the microwave signals transferred thereby. The assemblage is efficient in design in that it requires no boards or the like to provide support and that, with the exception of hubs 22 and 23, all of the elements of the assemblage have both a mechanical function and an electrical function. A significant factor in imparting rigidity to the structure as a whole of assemblage 20 is the rigid character of its various coaxial lines which serve as struts in coupling the hubs and the junction boxes to each other, and which are the only elements providing such couplings. That is, it is clear that if such coaxial lines were non-rigid, the hub 23, for example would not be maintained positionally fixed relative to hub 22.

Considering the electrical characteristics of assemblage 20, the outer conductors of all of its coaxial connectors and coaxial lines are electrically grounded. The midfrequency for the microwave signal transferred through primary connector 35 from or to the assemblage may conveniently be 1.847 GHz. All of the first coaxial line sections 50*a*–50*f* have the same electrical length, and all of the second coaxial line sections 100*a*–100*f* have the same electrical length.

The coaxial lines 50*a*–50*f* provide principal paths for transfer of signals between primary connector 35 and the secondary connectors 70*a*–70*f*, and the electrical impedance of each of these lines $=50\sqrt{N}=122$ ohms when $N=6$. The first fraction of a microwave signal at any one of such secondary connectors which is transmitted through ones of such principal paths to any other of such connectors as an extraneous signal is, as earlier described, opposed at such other connector by a second fraction of such signal traveling from such one to the other connector through ones of supplemental paths provided by coaxial line sections 100*a*–100*f*, and appearing at such other connector as a second fraction of an extraneous signal in 180° phase relation to the mentioned first fraction. In assemblage 20, that 180° phase relation between the two opposing fractions of the extraneous signal can in theory be obtained when, whatever be the electrical length of each of the first coaxial line sections, the electrical length of each of the second coaxial line sections is one-quarter wave length greater for the microwave signal considered than the length of the first coaxial line sections. In practice, however, it is preferable and convenient in assemblages 20 for the coaxial lines 50*a*–50*f*, 110*a*–110*f*, and 120*a*–120*f* to all have an electrical length which is one quarter the wave length of such microwave signal, and for the second coaxial line sections 100*a*–100*f* to all have an electrical length which is one half the wavelength of such signal. It follows that all of those individual lines 50, 110, and 120 will have the same mechanical length, and that the second coaxial line sections 100 will have a mechanical length which is double that of the first coaxial line sections 50.

In order for the two fractions of the extraneous signal manifested at any of the secondary connectors 70*a*–70*f* to best approach complete cancellation of each other, it is desirable that such fractions not only be opposite in phase but also be equal in amplitude. To the end of arriving in assemblage 20 to a good approximation of such equality of amplitude of those fractions, the coaxial lines 110*a*–110*f* and 120*a*–120*f* each have a characteristic impedance of 50 ohms, the coaxial lines 50*a*–50*f* each have a characteristic impedance of 122 ohms, the primary connector 35 has a characteristic impedance of 50 ohms, the secondary coaxial connectors 70*a*–70*f* have a characteristic impedance of 50 ohms, and the external load resistors 154 have a resistance of 50 ohms.

While assemblage 20 has been described in terms of its use as a combiner, it is equally capable of being used as a microwave signal splitter by making minor changes in the relationship of assemblage 20 to the external instrumentalities with which it is connected. The changes necessary to convert assemblage 20 into a splitter are that the external means 40 connected to primary connector 35 becomes a source of microwave signals supplied as an input to such connector, and that the connectors 70 supply microwave signals to the inputs of amplifiers 80.

When N is the number of secondary coaxial connectors, the number N for the particular splitter/combiner described above is six since six such connectors 70*a*–70*f* have been disclosed. However, assemblage 20 can be constructed so that N is the number 2 at a minimum or any integral number which is greater than 2 but small enough to permit incorporation of secondary connectors of that number within the structure of the assemblage.

FIGS. 7–10 show a microwave assemblage 200 constituting a compact exemplary embodiment of the invention. Assemblage 200 comprises a metallic housing 201 (of, say, aluminum) in the shape of an inverted pan and having (FIG. 8) a vertical axis 202. The housing 201 has a top closure provided by web means which is centered on and extends in both horizontal directions from axis 202, and which here takes the specific form of a circular plate 203 having formed in it a vertical bore 204 coaxial with that axis.

Plate 203 carries at its periphery a flange means 210 here in the specific form of a single continuous annular flange downstanding from the plate and extending in horizontally spaced relation from axis 202 angularly around it to bound an interior space 211 of housing 201 at the side of such space. The flange 210 may be either integral with plate 203 or may be an element fastened thereto.

Flange 210 is pierced by a first set of apertures in the form of bores 211*a*–211*d* extending horizontally through the flange and angularly spaced at equal intervals around axis 202.

The housing 201 further has a bottom cover means at the lower end of flange 210 and in the specific form of a circular plate 215 fastened to the bottom of the flange by screws, not shown passing through holes in the plate into threaded holes in the flange. Plate 215 provides a bottom closure for housing 201.

Assemblage 200 includes as its top (FIG. 8) a primary coaxial signal transfer connector 220 comprising a tubular outer conductor 221 mounted on the outside of plate 203 over bore 204 by screws 219 passing through the conductor into the plate. The connector 220 further comprises an inner filamental conductor 222 and dielectric materal 223 disposed between the two conductors above plate 203 and forming below that plate a plug extending down into bore 204. The inner conductor 222 passes vertically down through and beyond that plug to terminate in a free end in the space 211 of housing 201. Except for being shaped to have at its top a right angle bend, the connector 220 is substantially the same in structure and functional capability as the connector 35 of FIG. 2.

The housing space 211 contains (FIG. 9) four "first" coaxial line sections 230*a*–230*d* angularly spaced at 90° intervals around axis 202 and extending radially between that axis and, respectively the four bores 211*a*–211*d* formed in the flange 210. The "first" coaxial sections 230 (FIG. 9) are counterparts in function and structure of the first coaxial line sections 50 of the FIG. 1 assemblage. The sections 230*a*–230*d* are one piece coaxial lines which comprise respective tubular outer conductors 231*a*–231*d* and respective filamental inner conductors 232*a*–232*d* projecting at the opposite ends of such sections beyond such outer conductors. At their radially inner ends, all of inner conductors 232*a*–232*d* make an electromechanical junction 233 with the free end of the inner conductor 222 of the primary connector 220.

Disposed in registering relation with the bores 211a–211d in flange 210 are four secondary signal transfer connectors 240a–240d comprising respective tubular outer conductors 241a–241d mounted by screws 239 to the outside of flange 210, respective filamental inner conductors 242a–242d, and bodies of dielectric material interposed outside flange 210 between the conductors of such connectors forming plugs of such material projecting into the bores 211. The inner conductors 242a–242d of such connectors pass radially inward through such plugs to be respectively coupled with the inner conductors 232a–232d of the first coaxial line sections 230. Secondary signal transfer connectors 240 are counterparts in structure and function of the connectors 70 of the FIG. 1 embodiment.

The space 211 in housing 201 contains besides the "first" coaxial line sections 230a–230d a set of respectively corresponding L-shaped second coaxial line sections 250a–250d which are counterparts in function (and partial counterparts in structure) to the "second" coaxial line sections 100 of the FIG. 1 embodiment. The second coaxial line sections each have two arms which meet at a common bend, and which arms comprise respective "chordal" coaxial lines 251a–251d and respective "diametral" coaxial lines 252a–252d, so called because they are respectively substantially aligned with chords and diameters of the circular interior space 211 of housing 201.

The chordal lines 251 of sections 250 are counterparts in structure and function of the coaxial lines 110 of the sections 100 of FIG. 2, and the diametral lines 252 are counterparts in structure and function of the coaxial lines 120 of such sections 100. As a first difference between sections 100 and 250, the two arms in each of the latter sections 250 are not coupled together by junction boxes as are the two arms in each of the former sections 100. As a second difference, the angle between the two arms in each of sections 250 at the bend between the arms is approximately 60° as contrasted to the corresponding angle of 90° in the sections 100.

The chordal lines 251 of section 250 comprise respective rigid tubular outer conductors 253a–253d, respective filamental inner conductors 254a–254d projecting at opposite ends of the lines 251 out beyond the corresponding outer conductors thereof, and dielectric material interposed in the lines 251 between their outer and inner conductors. Similarly the diametral lines 252 comprise respective rigid tubular outer conductors 255a–255d, respective filamental inner conductors 256a–256d projecting at opposite ends of the lines 252 out beyond the outer conductors thereof, and dielectric material interposed in the lines 252 between their outer and inner conductors.

In the second coaxial line sections 250, the outer conductors of the chordal lines 251 are electromechanically coupled by solder at the bends of the sections to the outer conductors of the diametral lines 252 such that the respective chordal lines and diametral lines of those sections are joined in positionally fixed relation. Further in sections 250, the inner conductors of the chordal lines are coupled at the bends of such sections with the inner conductors of the diametral lines at electromechanical junctions 257a–257d of such inner conductors.

With regard to the coupling of the "second" coaxial line sections 250 to their respectively corresponding first coaxial line sections, the inner conductors of the chordal lines of sections 250 are, at the ends of such conductors remote from the bends in such sections, respectively coupled at the electromechanical junctions 243a–243d with the radially outer ends of the inner conductors of the first coaxial line sections 230 which respectively correspond to these second sections 250. In contrast, the inner conductors of the diametral lines of sections 250 are, at the ends of such conductors remote from the bends in such sections, all coupled together at a common electromechanical junction 259 (FIG. 8) which, electrically speaking, is a common floating point. Junction 259 is on axis 202 a small distance down from the junction 223 of primary connector 220 with coaxial lines 230.

The mentioned junctions 257 of the inner conductors 254 and 256 of the second coaxial line sections 250 are as shown (FIG. 9) all disposed adjacent to the inside of housing flange 210 in equiangularly spaced relation around that flange. In the FIG. 7 assemblage, the flange 120 is pierced at the angular locations of those junctions by a second set of apertures here in the specific form of bores 270a–270d extending horizontally through the flange. Bores 270 are formed in flange 210 at a somewhat lower vertical level than are the earlier described bores 211 in that flange.

Disposed in registering relation with the four bores 270a–270d are four external load coaxial connectors 280a–280d which correspond in structure and function to the external load connectors 150 of the FIG. 1 assemblage. The connectors 280a–280d comprise respective rigid tubular conductors 283a–283d mounted by screws 282 to the outside of flange 210, respective filamental inner conductors 283a–283d, and dielectric material interposed outside flange 210 between the outer and inner conductors of such connectors and forming plugs of such material projecting into the bores 270. The inner conductors 283a–283d pass radially inward through and beyond such plugs and the surrounding bores 270 to enter the interior space 211 of housing 201 and to there be respectively coupled with the previously mentioned junctions 257a–257d, at the bends of the "L" shaped coaxial line sections 250, with the inner conductors of the two arms in each of such sections.

The second coaxial line sections 250a–250d are supported in positionally fixed relation relative to their respectively corresponding first coaxial line sections 230a–230 by coupling by solder the free ends of the two arms of each of such second sections to the adjacent ones of the opposite ends of the coaxial lines of the corresponding first sections. In other words, the outer conductors respective to the two arms of each such second section are electromechanically coupled by solder at their ends remote from the bends in such section to the ones nearest thereto of the opposite ends of the outer conductor of the first coaxial line section corresponding to that second section. As a result of such coupling, all of the outer conductors of the first and second coaxial line sections are at the same potential and, in practice, are also electromechanically coupled with the housing 201 and are grounded.

Figure 7:
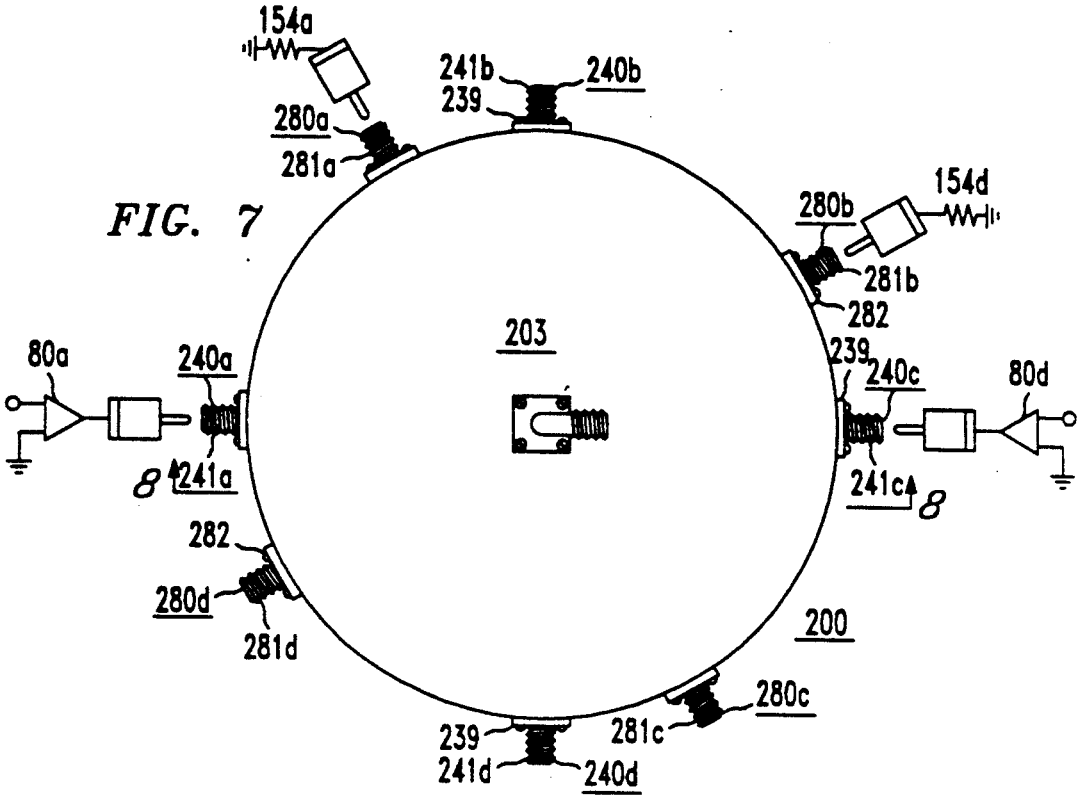
FIG. 7 is a plan view of another embodiment of the invention constituting a microwave combiner of compact configuration.

The FIG. 7 assemblage is usable either as a combiner or a splitter by appropriately coupling it to amplifiers, load resistors, and/or other external elements described and shown (FIG. 5) in connection with the FIG. 1 assemblage, and some exemplary ones of which are shown in FIG. 7. The manner in which the FIG. 7 assemblage should be coupled to these elements for its use as a combiner or splitter will be self-evident from the description already given of the coupling of the FIG. 1 assemblage for those purposes and, accordingly, need not be treated of here in further detail.

In the FIG. 7 assemblage as in the FIG. 1 assemblage, all of the first coaxial line sections are of the same mechanical length in relation to each other, and all of the second coaxial line sections are of the same mechanical length in relation to each other. Further, in the FIG. 7 assemblage, the coaxial lines of the first coaxial sections and the chordal and diametral coaxial lines of the second coaxial sections are, all of them, equal in mechanical length with each other. Hence, as shown in FIG. 9, the coaxial line of each first section and the chordal and diametral coaxial lines of the corresponding second section together define a triangular figure which if closed at its vertex at or about axis 202 would be approximately an equilateral triangle. In practice however, such figure is often not closed at the vertex because the common floating point junction 259 is vertically spaced away by a small amount from the junction 233 of the inner conductor of the primary connector 220 with those of the coaxial lines 230.

The FIG. 7 assemblage is adopted to suppress extraneous signals in the same way as does the FIG. 1 assemblage, and the earlier description of how such suppression is effected by the use in the FIG. 1 assemblage of appropriate electrical lengths for the coaxial lines and other appropriate electrical conditions is a description which applies fully to the FIG. 7 assemblage. As a specific example given here, in that FIG. 7 assemblage all of the coaxial lines 230, 251, and 252 have an electrical length of one quarter wave length, all of the lines 230 have a characteristic impedance of 100 ohms, and all of both the lines 251 and 252 have a characteristic impedance of 50 ohms.

Figure 8:
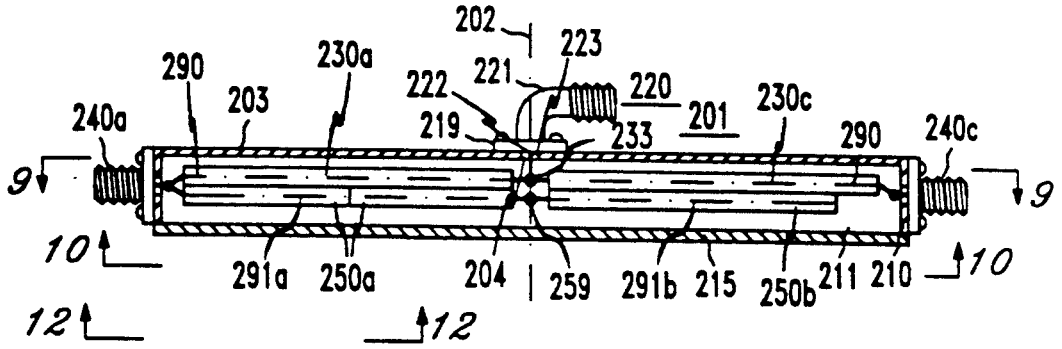
FIG. 8 is an enlarged front elevation of the FIG. 7 combiner with the frontwardly projecting coaxial lines thereof (see FIG. 9) being removed, and with most of the front half of the combiner's housing being removed to show in cross-section the remainder of that housing.
Figure 10:
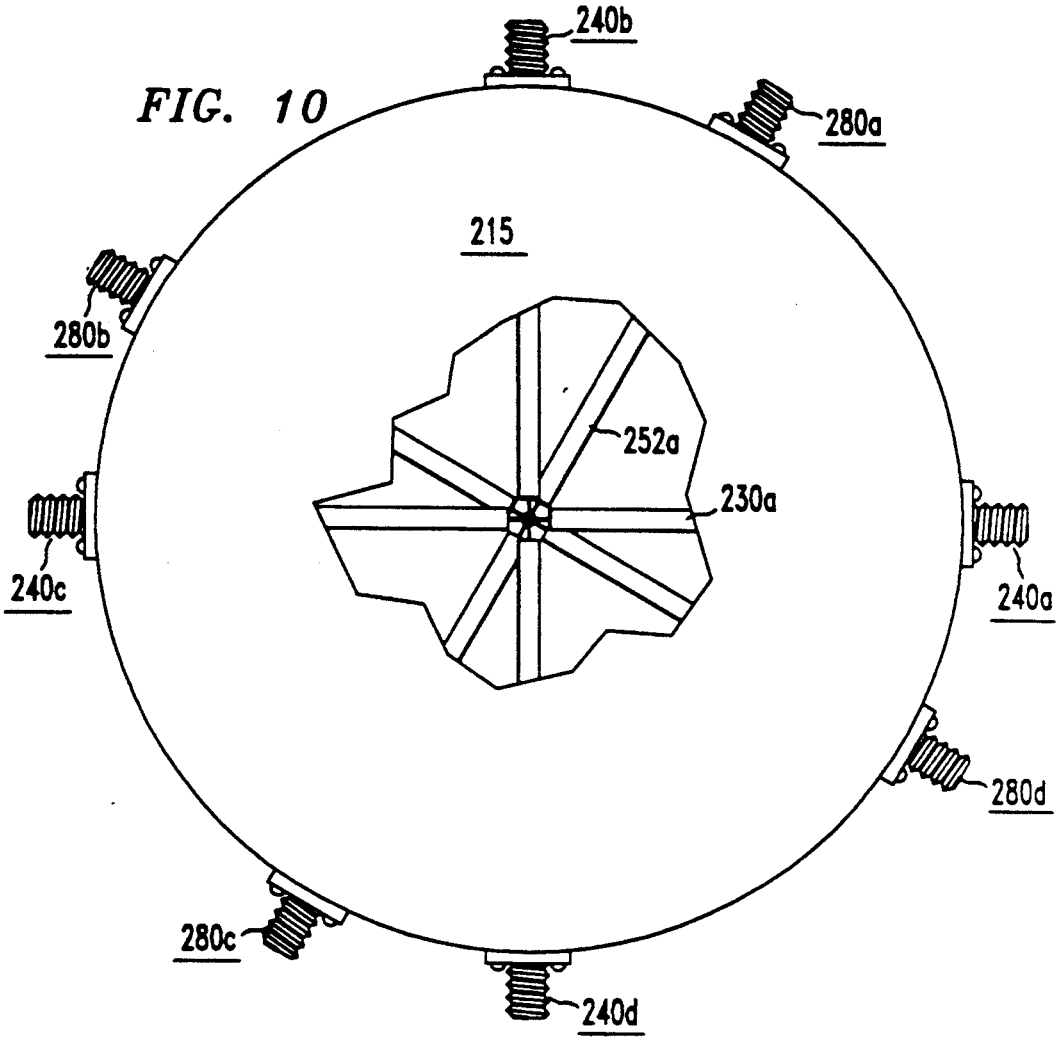
FIG. 10 is a bottom view of such combiner.

Now comparing and contrasting the geometries of the embodiments of FIGS. 1 and 7, in the FIG. 1 assemblage the "first" coaxial line sections 50 all lie in a common horizontal plane normal to that assemblage's vertical axis 21, and each of the "second" coaxial line sections 100 is disposed below the corresponding first section 50 in a plane containing that section 100 and which last-named plane is vertical and, thus, normal to the mentioned horizontal plane commonly containing all the sections 50. In the FIG. 7 assemblage, all of the first coaxial line sections 230 lie as before in a common horizontal plane 290 normal (FIG. 8) to the axis 202 of the assemblage. In that assemblage, however, it is not true that the second coaxial line sections 250 lie in respective vertical planes each normal to such horizontal plane 290. Instead, in the assemblage 200, the second coaxial sections 250*a*–250 lie in respective planes 291*a*–291*d* which are all displaced away from the vertical in the same angular direction (clockwise or counterclockwise) around the axis 202 of that assemblage. Here the way in which such sections 250 are so displaced can be envisaged by assuming that they initially have dispositions similar to the sections 100 of the FIG. 1 assemblage so as to be in respective vertical planes, and by then assuming that each such section 250 is tilted away from the vertical in the same angular direction and around axis 202 to rotate the plane 291 containing that section 250 towards the horizontal plane 290 around a line of intersection (which may be adjustable in position) of that plane 291 with the plane 290 until the sections 250 are brought to their final desired position within housing 201. When this is done, each of such second sections 250 will, as shown (FIG. 9), angularly project from its corresponding first section 230 towards the next adjacent section 230 in the angular direction in which such second section 250 has been tilted. FIG. 8 illustrates the extreme case in which such angular displacement of the planes of the second sections 250 has been carried through 90° and, in which accordingly, the planes 291 which respectively contain the sections 250 are in themselves horizontal and parallel to plane 290.

In the design of splitter combiners of the kind described, a significant advantage in displacing the containment planes 291 for the second sections 250 away from normal to the common plane 290 for the first sections 230 is that it provides an effective means for substantially reducing in one of the spatial dimensions of the assemblage the size of the assemblage relative to its other dimensions. That such is so will be evident from the comparison of the FIG. 1 assemblage (of which its vertical dimension is not much smaller than its horizontal dimension) to the FIG. 7 assemblage in which the vertical dimension is so small relative to the horizontal dimension that the assemblage, including its housing, is of flat configuration and resembles an inverted pan. To put it another way, the FIG. 7 embodiment can be said to have a "pancake" configuration.

In order to realize the benefits of the invention hereof, it is not necessary for the planes 291 of the second coaxial sections 250 to be horizontal (i.e., parallel) to the plane 290 of the first coaxial sections 230 so as to make a 0° angle with the latter plane as shown in FIG. 8. Rather, these benefits are well realized also when there is an alignment between planes 291 and plane 290 departing from such parallel relation by at most an acute angle which is small (i.e., an acute angle having a tangent of 1.0 or less).

Figure 11:
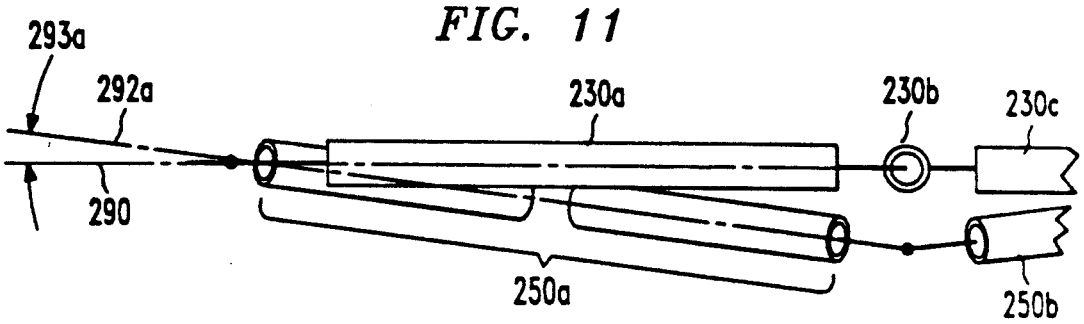
FIG. 11 is a broken-away front elevational view taken as indicated by the arrows 11—11 in FIG. 9, of a modification of one of the details of the FIG. 7 combiner.

FIG. 11 is an illustration of a portion of the FIG. 7 assemblage as modified so that such non-parallel alignment occurs. In the FIG. 11 modification, the first coaxial lines 230 lie as before in the common horizontal plane 290. In that modification, however, the planes respectively containing the second coaxial sections 250 each make a small acute angle with the plane 290. For example and as depicted, in FIG. 11, the coaxial section 250*a* lies in a plane 292*a* which is normal to a vertical plane (not shown) passing through the centerline of coaxial line 230, and which plane 292*a* makes a small acute angle 293*a* with the plane 290.

FIG. 12 shows another modification of the FIG. 7 assemblage in which the bores 270, and the external load coaxial connectors 280 have been eliminated because the load resistors for the assemblage have been brought inside housing 201. FIG. 12 shows one such load resistor 154*a* mounted on a metal stand 295 affixed by a screw 296 to the top closure or roof 203 of the housing 201. As shown, resistor 154*a* is connected directly to the junction 257*a* at the bend of the L-shaped coaxial line section 250*a*. The chordal line 251*a* of that section has in the FIG. 12 modification a lie in a horizontal plane also containing coaxial line 230*a* so that line 251*a* over its length is close to or in contact with the underside of the top closure plate 203 of the housing. Line 251*a* thus may be readily affixed over its length to plate 203 to thereby enhance the rigidity of the support of all of coaxial section 250*a* within housing 201.

It will be understood that a modification similar to that shown by FIG. 12 is made for each of the other second coaxial line sections 250*b*–250*d* so as to bring all of the load resistors for those sections within housing 201.

The above described embodiments being exemplary only, it will be understood that additions thereto, subtractions therefrom and modifications thereof can be made without departing from the spirit of the invention. By way of examples without restriction, the invention involving vertical compacting exemplified by the embodiment of FIGS. 7-12 is of application without the incorporation in the embodiment of the housing 201. In the practice of the invention, obviously less secondary signal transfer ports may be used than the four ports shown in FIG. 7 and, also a greater number than four of such ports may be used. The theoretical limit in the number of such secondary ports which may be used consonant with obtaining an ideally flat or pancake configuration for the assemblage is six ports since only six of the equilateral triangles formed by the primary coaxial line sections 230 and the secondary coaxial line sections 250 will fit flatly in relation to each other around axis 202, the result being a hexagon. If, however, more than six secondary ports are desired to be accommodated in the assemblage, such can be done by tilting the containing planes for the second coaxial line sections in relation to the plane containing the first sections to an acute angle which is greater in size than the size to which such angle could be reduced if, say, only four secondary ports were present.

Accordingly, the invention is not to be considered as limited save as is consonant with the scope of the following claims.

I claim:

1. A microwave assemblage comprising: a metallic housing having a vertical axis and an inverted pan shape and comprising, web means centered on said axis and extending in both horizontal dimensions away from said axis to provide a top closure for said housing, said web means having therein a vertical bore coaxial with said axis, flange means downstanding from said web means and extending in horizontally spaced relation from said axis angularly around it to bound at the side an interior space in said housing under said web means, said flange means having formed therein a plurality of horizontally extending through apertures angularly spaced around said axis, and cover means disposed at the lower end of said flange means and providing a bottom closure for said housing, said assemblage further comprising, a primary coaxial signal transfer connector having an outer conductor disposed outside of and mounted on said web means, and having an inner conductor passing down through said bore into said space, a plurality of secondary coaxial signal transfer connectors each corresponding to a respective one of said apertures and each comprising an outer conductor on said flange means outside the respective aperture and an inner conductor passing through that aperture into said space, a plurality of first equal-length coaxial line sections respectively corresponding to said plurality of second connectors and disposed in said space and each extending horizontally therein between said axis and the one of said apertures corresponding to the second connector associated with the first section, said first sections each comprising a tubular outer conductor and an inner conductor coupled in said space at opposite ends thereof, towards and away from said axis, to respectively, (a) a junction of such inner conductor with the inner conductor of said primary connector, and (b) the inner conductor of the secondary connector respectively corresponding to that first line section, and a plurality of second coaxial line sections respectively corresponding to said first line sections and each in the shape of an "L" to have two arms and a bend therebetween, and each such section at the free ends of said arms having opposite section ends which are towards and away from said axis and are respectively adjacent to the corresponding opposite ends of the inner conductor of the first line section corresponding to such second section, said second coaxial line sections comprising respective tubular outer conductor means and respective inner conductor means of which the latter are, at the ends of such second line sections towards said axis, all coupled together to a common, floating junction and, at the ends of such second sections away from said axis, each coupled to the said junction of the inner conductor of the corresponding first coaxial line section with the inner conductor of the corresponding secondary signal transfer connector, said second coaxial line sections being all disposed in said interior space to be tilted away from the vertical in the same angular direction around said vertical axis so that each of said second coaxial line sections projects angularly away from the corresponding first coaxial line section towards the first coaxial line section next adjacent in such angular direction, said second coaxial line sections being all of greater length that said first coaxial line sections.

2. A microwave assemblage comprising, a primary coaxial signal-transfer connector having a vertical axis, a plurality of first coaxial line sections extending horizontally from, and in angularly spaced relation around said connector from inner ends adjacent to and electrically coupled to said connector to outer ends of such sections, a plurality of secondary coaxial signal-transfer connectors respectively corresponding to said first sections and disposed at their outer ends in electrically coupled relation therewith, a plurality of second coaxial line sections respectively corresponding to said first sections and each of "L" shape so as to have two arms and a bend therebetween and having respective outer and inner ends disposed at the ends of such arms away from the bends in such sections, and of which such outer ends of said second sections are mechanically and electrically coupled with said first sections at their outer ends, and of which the inner ends of said second sections are adjacent to each other and electrically and mechanically coupled together at a common junction, said second coaxial line sections lying in respective planes which are disposed to be tilted away from the vertical in the same angular direction around said vertical axis so that each of said second coaxial line sections projects angularly away from the corresponding first coaxial line section towards the first coaxial line section next adjacent in such angular direction.

3. A microwave assemblage according to claim 2 in which said L-shaped second coaxial line sections lie in respective planes which all depart by at most a small acute angle from a plane at right angles to said axis.

4. A microwave assemblage according to claim 2 in which said first coaxial line sections comprise respective rigid equal-length linear coaxial lines, the two arms of each second coaxial line section each comprises a rigid linear coaxial line of substantially the same length as the coaxial line of the corresponding first coaxial line section, and the two constituent coaxial lines of each of said second coaxial line sections are at an angle to each other of less than 90° at the bend in such section between such two constituent lines.

5. A microwave assemblage according to claim 4 in which said angle approximates 60°.

* * * * *